US005940983A

United States Patent [19]

Lu

[11] Patent Number: 5,940,983

[45] Date of Patent: Aug. 24, 1999

[54] DEHYDRATING DEVICE

[76] Inventor: Shun-Tsung Lu, No. 160-2, Sec. 2, Fu Hsing Rd., Taichung, Taiwan

[21] Appl. No.: 09/044,223

[22] Filed: Mar. 19, 1998

[51] Int. Cl.[6] ..... F26B 19/00

[52] U.S. Cl. ..... 34/212; 34/215; 34/219

[58] Field of Search ..... 34/548, 549, 550, 34/583, 73, 75, 76, 77, 201, 202, 205, 209, 210, 212, 215, 219; 62/390, 331; 99/468, 470, 483; 426/520, 523

[56] References Cited

U.S. PATENT DOCUMENTS

| | | | |
|---|---|---|---|
| 2,421,121 | 5/1947 | Haagen-Smit | 34/74 |
| 4,244,949 | 1/1981 | Roderick | 426/418 |
| 4,987,688 | 1/1991 | Petit et al. | 34/212 X |
| 5,507,618 | 4/1996 | Kubo et al. | 415/182.1 |
| 5,595,109 | 1/1997 | Shelton | 99/476 |
| 5,675,906 | 10/1997 | Li et al. | 34/215 X |

*Primary Examiner*—Henry Bennett
*Assistant Examiner*—Steve Gravini
*Attorney, Agent, or Firm*—Bacon & Thomas, PLLC

[57] ABSTRACT

A hydrating device includes a food processing chamber and a control unit which communicates with the chamber via two connecting pipes. The control unit has an inclined separating board inclinedly disposed therein and a water exit located corresponding to an upper surface of the inclined separating board. A compressor having an evaporating pipe and a condensing pipe is disposed in the control unit, wherein the condensing pipe and a first section of the evaporating pipe are located in the control unit, and a second section of the evaporating pipe is located outside the control unit. A heating member is disposed in the control unit and located above the first section of the evaporating pipe. A first set of ventilators is disposed below the heating member for sucking dry air to the chamber and a second set of ventilators is disposed beside the second section of the evaporating pipe for cooling the evaporating pipe.

2 Claims, 3 Drawing Sheets

DEHYDRATING DEVICE

BACKGROUND OF THE INVENTION

1. Field of the Invention

The present invention relates to a dehydrating device and, more particularly, to a dehydrating device for reducing the moisture content of food such as fruits or prunes. The dehydrating device includes a food processing chamber and a control unit which communicates with the processing chamber by two pipes. The control unit includes a heating member, a compressor, a condenser and ventilators, all of which are disposed therein so as to properly control a temperature of air entering the processing chamber.

2. Brief Description of the Prior Art

Some types of food are made by at least one step of dehydrating to reduce the moisture content of the food so as to conveniently preserve the food. Especially for some types of fruits, such as bananas, it is desired to maintain these fruits with a good outer appearance. If the temperature of the dehydrating process is too high, the fruits could become dark which is not attractive to consumers.

The present invention intends to provide a dehydrating device which has a compressor, a condenser, a heating member and a plurality of ventilators which together properly control temperature of air entering a food processing chamber so as to mitigate and/or obviate the above-mentioned problems.

SUMMARY OF THE INVENTION

The present invention provides a dehydrating device comprising a food processing chamber having a first inlet and a first outlet, a control unit disposed beside the food processing chamber and having a second inlet and a second outlet. A connecting pipe is connected between the second outlet and the first inlet, and a second connecting pipe is connected between the first outlet and the second inlet.

The control unit has an inclined separating board transversely disposed with respect to a longitudinal axis thereof and a water exit defined through a peripheral wall of the control unit, wherein the water exit is located corresponding to an upper surface of the inclined separating board. A compressor is disposed in the control unit and has an evaporating pipe and a condensing pipe. The condensing pipe and a first section of the evaporating pipe are each located in the control unit, and a second section of the evaporating pipe is located outside the control unit. A heating member is disposed in the control unit and located above the first section of the evaporating pipe.

A first set of ventilators is disposed below the heating member so as to suck dry air from the control unit into the food processing chamber, and a second set of ventilators is disposed beside the second section of the evaporating pipe so as to cool the second section of the evaporating pipe.

It is an object of the present invention to provide a dehydrating device which is able to dehydrate a large amount of food within a food processing chamber of the device.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
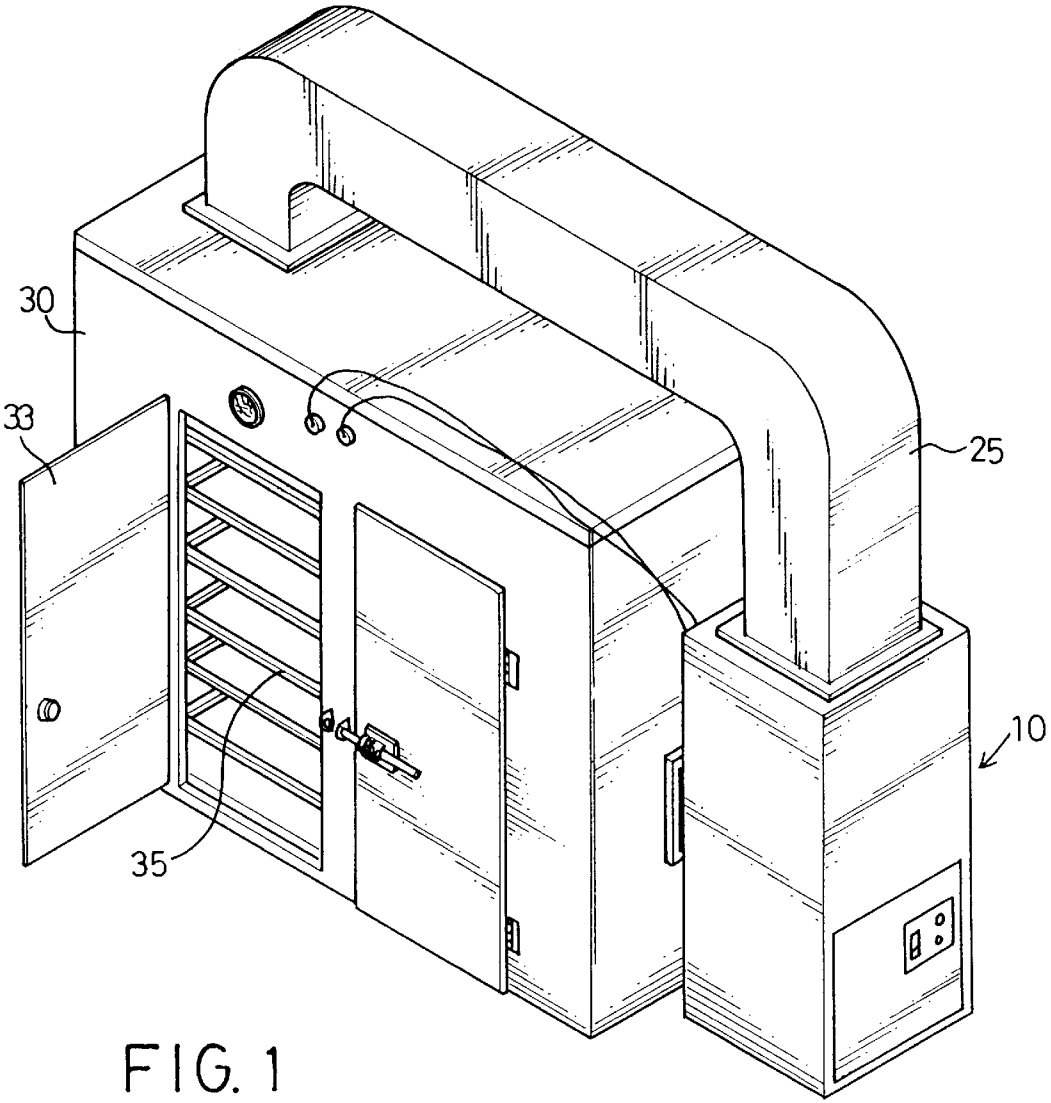
FIG. 1 is a perspective view of a dehydrating device in accordance with the present invention.
Figure 2:
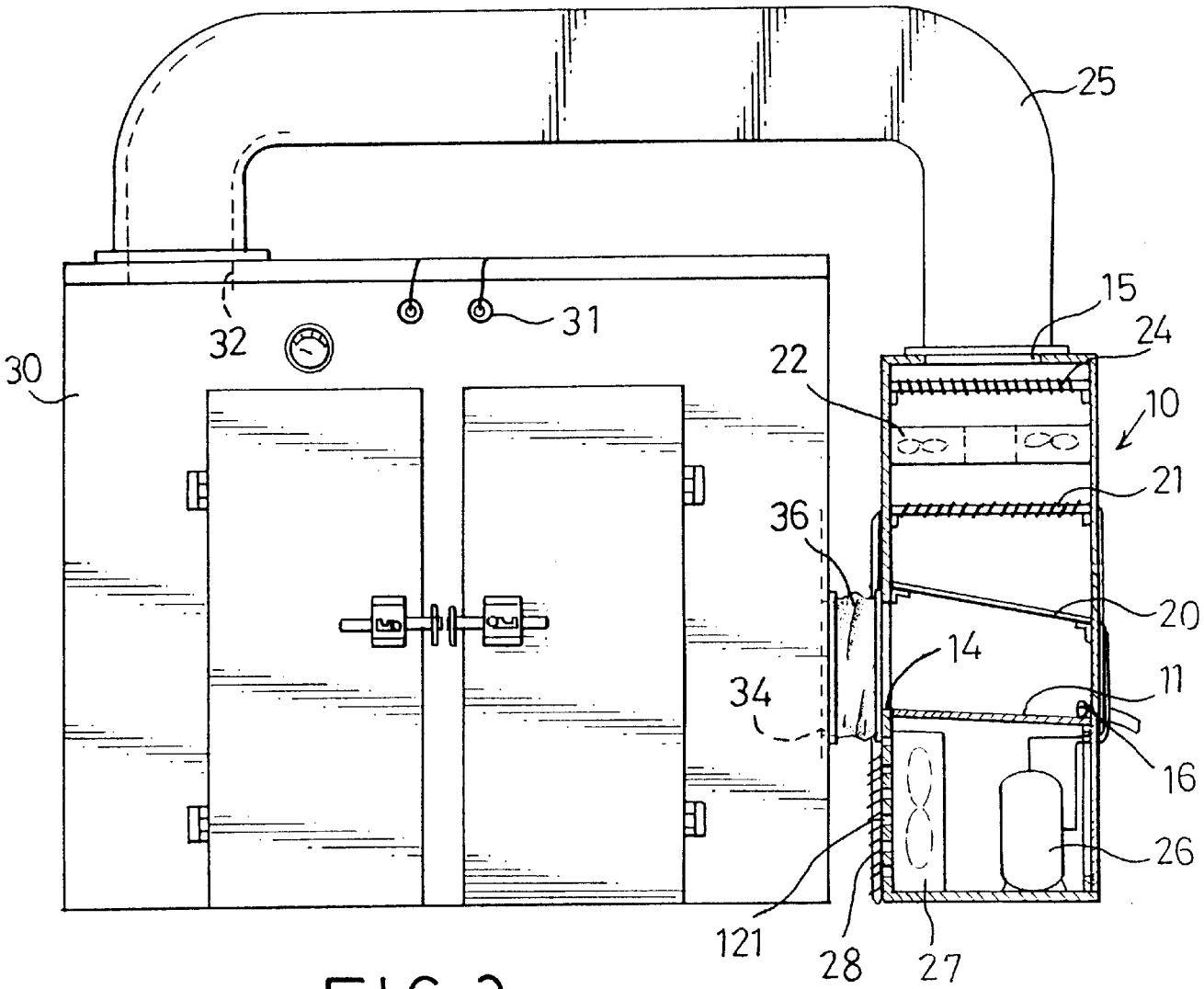
FIG. 2 is a side elevational view, partly in section, of the dehydrating device of the present invention.

Referring to the drawings and initially to FIGS. 1 and 2, a dehydrating device in accordance with the present invention generally includes a food processing chamber 30 having a first inlet 32 and a first outlet 34 respectively defined through a peripheral wall thereof, and a control unit 10 which is disposed beside the food processing chamber 30 and has a second inlet 14 and a second outlet 15 defined through a peripheral wall thereof. A first connecting pipe 25 is connected between the second outlet 15 and the first inlet 32, a second connecting pipe 36 connected between the first outlet 34 and the second inlet 14. The food processing chamber 30 has two doors 33 and a plurality of shelves 35 removably disposed therein so that food to be dehydrated can be put on the shelves 35. The food processing chamber 30 further has at least one temperature sensor 31 disposed thereto.

The control unit has an inclined separating board 11 disposed transversely with respect to a longitudinal axis thereof and a water exit 16 defined through the peripheral wall of the control unit 10. The water exit 16 is located corresponding to an upper surface of the inclined separating board 11 so as to let condensed water on the inclined separating board 11 drain away. A compressor 26 is disposed in the control unit 10 and has an evaporating pipe not numbered and a condensing pipe 20 which together form a loop. The condensing pipe 20 and a first section 21 of the evaporating pipe are located in the control unit 10, and a second section 28 of the evaporating pipe is located outside the control unit 10. A heating member 24 is disposed in the control unit 10 and located above the first section 21 of the evaporating pipe.

A first set of ventilators 22 is disposed below the heating member 24 so as to suck dehydrated air from the control unit into the food processing chamber 30 via the first pipe 25, and a second set of ventilators 27 is disposed in the control unit 10 and located beside the second section 28 of the evaporating pipe so as to cool the second section 28 of the evaporating pipe.

When the dehydrating device is operated, air in the food processing chamber 30 will be sucked into the control unit 10 and is cooled by the condensing pipe 20, water particles in the air will be condensed by the condensing pipe 20 and drop on the inclined separating board 11 and drain from the water exit 16. The dehydrated air then is heated by the first section 21 of the evaporating pipe and the heating member 24 and sucked by the first set of ventilators 22 into the food processing chamber 30 via the first connecting pipe 25. Food in the food processing chamber 30 is then dehydrated by the dehydrated air enter from the first inlet 32. Air in the food processing chamber 30 is sucked again into the control unit 10 to continue the processes described above to become dehydrated air. A part of the peripheral wall located between the second section 28 of the evaporating pipe and the second set of the ventilators 27 has a plurality of holes 121 defined therethrough so that the second section 28 of the evaporating pipe can be cooled by the second set of ventilators 27 accurately.

When a temperature of the dehydrated air in the food processing chamber 30 is so high and beyond a desired temperature set to the temperature sensors 31, the second set of ventilators 27 is actuated to cool the second section 28 of the evaporating pipe and an operation status of the heating member 24 is accordingly adjusted so as to reduce the temperature of the air in the control unit 10 such that the temperature of the dehydrated air will be lowered and food will not be burned. Accordingly, the dehydrating device of the present invention is able to dehydrate a large amount of food and the temperature of the dehydrated air can be controlled.

Figure 3:
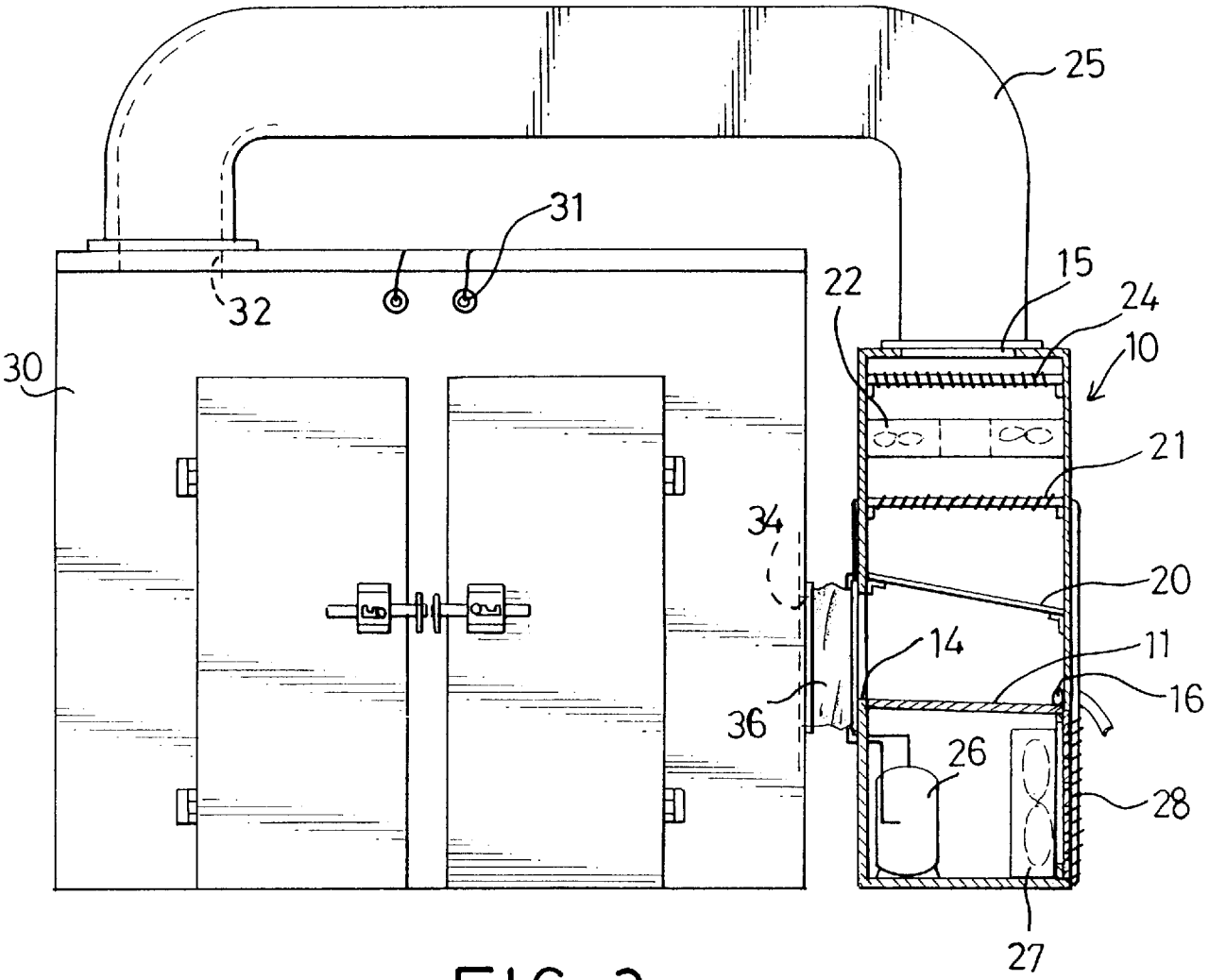
FIG. 3 is a side elevational view, partly in section, of another embodiment of the dehydrating device of the present invention.

Referring to FIG. 3, the second section 28 of the evaporating pipe and the second set of ventilators 27 can be disposed to the control unit 10 at a side opposed to original location and located away from the food processing chamber 30 so as to provide a better ventilation condition.

Although the invention has been explained in relation to its preferred embodiment, it is to be understood that many other possible modifications and variations can be made without departing from the spirit and scope of the invention as hereinafter claimed.

What is claimed is:

1. A dehydrating device comprising:

a food processing chamber having a first inlet and a first outlet respectively defined through a peripheral wall thereof;

a control unit disposed beside said food processing chamber and having a second inlet and a second outlet defined through a peripheral wall thereof, a first connecting pipe connected between said second outlet and said first inlet, a second connecting pipe connected between said first outlet and said second inlet;

said control unit having an inclined separating board disposed transversely with respect to a longitudinal axis thereof and a water exit defined through said peripheral wall of said control unit, said water exit located corresponding to an upper surface of said inclined separating board, a compressor disposed in said control unit and having an evaporating pipe and a condensing pipe, said condensing pipe and a first section of said evaporating pipe located in said control unit, a second section of said evaporating pipe located outside said control unit, a heating member disposed in said control unit and located above said first section of said evaporating pipe, and a first set of ventilators disposed below said heating member so as to suck dry air from said control unit into said food processing chamber, and a second set of ventilators disposed in said control unit and located beside said second section of said evaporating pipe so as to cool said second section of said evaporating pipe.

2. The as claimed in claim 1 wherein said food processing chamber has at least one temperature sensor disposed thereto.

* * * * *